US008464904B2

(12) United States Patent
Woodruff

(10) Patent No.: US 8,464,904 B2
(45) Date of Patent: Jun. 18, 2013

(54) METHODS AND CONTAINERS FOR REDUCING SPILLAGE AND RESIDUAL LIQUID WHEN POURING LIQUID OUT OF A CONTAINER

(76) Inventor: James M. Woodruff, Swift Current (CA)

( * ) Notice: Subject to any disclaimer, the term of this patent is extended or adjusted under 35 U.S.C. 154(b) by 379 days.

(21) Appl. No.: 12/712,281

(22) Filed: Feb. 25, 2010

(65) Prior Publication Data

US 2010/0264161 A1 Oct. 21, 2010

Related U.S. Application Data

(60) Provisional application No. 61/170,423, filed on Apr. 17, 2009.

(51) Int. Cl.
*G01F 11/00* (2006.01)

(52) U.S. Cl.
USPC ..... 222/1; 222/212; 222/495

(58) Field of Classification Search
USPC ..... 215/266; 222/1, 67, 212, 495
See application file for complete search history.

(56) References Cited

U.S. PATENT DOCUMENTS

| | | | | |
|---|---|---|---|---|
| 41,067 | A | 1/1864 | Hamilton | |
| 2,099,629 | A | 11/1937 | Schaetzel | |
| 2,317,626 | A | 4/1943 | Marino et al. | |
| 3,138,278 | A | 6/1964 | Butts | |
| 3,194,439 | A | 7/1965 | Beduerftig | |
| 4,049,162 | A * | 9/1977 | Yule | 222/476 |
| 4,508,246 | A * | 4/1985 | Grenn | 222/477 |
| 4,741,448 | A * | 5/1988 | Alley et al. | 215/266 |
| 4,789,082 | A | 12/1988 | Sampson | |
| 5,000,353 | A * | 3/1991 | Kostanecki et al. | 222/207 |
| 5,370,266 | A * | 12/1994 | Woodruff | 222/1 |
| 5,947,344 | A * | 9/1999 | Jangaard | 222/494 |
| 5,988,415 | A * | 11/1999 | White | 215/266 |
| 5,996,860 | A * | 12/1999 | Alley | 222/564 |
| 7,121,436 | B2 * | 10/2006 | Lee et al. | 222/477 |
| 8,056,761 | B2 * | 11/2011 | Delgado | 222/67 |

FOREIGN PATENT DOCUMENTS

| | | |
|---|---|---|
| FR | 2294919 | 7/1976 |

* cited by examiner

*Primary Examiner* — Kevin P Shaver
*Assistant Examiner* — Christopher Bahr
(74) *Attorney, Agent, or Firm* — Kyle R. Satterthwaite; Ryan W. Dupuis; Ade & Company Inc

(57) ABSTRACT

A method of reducing spillage and residual liquid when pouring liquid includes temporarily deforming a liquid-carrying resilient container to press a buoyant member into a position sealing a fluid flow passage of the container, which is then inverted and the force is released to permit the member to float away from the passage such that liquid freely passes therethrough. When the fluid level is no longer sufficient to float the member away from the passage, an additional step prevents the ball from becoming or remaining seated in the sealing position so that residual liquid left in the container can be drained through the passage. Novel containers feature a ball-shaped member of larger size relative to the passage to ease unseating of the member therefrom for draining of residual liquid, and novel two-piece container constructions accommodate insertion of such larger balls prior to final assembly of the container.

15 Claims, 17 Drawing Sheets

METHODS AND CONTAINERS FOR REDUCING SPILLAGE AND RESIDUAL LIQUID WHEN POURING LIQUID OUT OF A CONTAINER

This application claims benefit under 35 U.S.C. 119 of U.S. Provisional Patent Application Ser. No. 61/170,423, filed Apr. 17, 2009.

FIELD OF THE INVENTION

The present invention relates to a method for reducing spillage and residual liquid left behind when pouring liquid out of a container.

BACKGROUND OF THE INVENTION

A variety of liquids are packaged for use in containers which are intended to be inverted to pour the contents into another container where they are ultimately consumed. One common example is motor oil. In order to add motor oil to an engine, the container filled with oil must be aligned with an oil receiving opening provided in the engine for that purpose. In the process of inverting a full container of oil it is common for a portion of the contents to be spilled over the engine and onto the ground. It is undesirable to spill an environmental pollutant liquid, such as oil. However, even when the liquid is not a pollutant it is desirable to avoid spilling liquid for reasons of cleanliness, convenience and waste-minimizing efficiency.

Applicant's prior patent issued under U.S. Pat. No. 5,370,266, which is fully incorporated herein by reference, teaches a method of reducing spillage when pouring liquid out of a container. A free floating buoyant member is placed into a resilient deformable container adapted for containing liquid of greater density than the member such that the member floats upon the surface of the liquid. A fluid flow passage of the container is narrower than the dimensions of the member such that the member is prevented from exiting through the fluid flow passage. In use, a force is exerted to temporarily deform the container, thereby reducing the volume of the inner cavity and causing the liquid in the container to press the member into a position sealing the fluid flow passage. The container is then inverted into a pouring position, where the force upon the container is released such that the container resiliently resumes its original shape thereby increasing the volume of the inner cavity and permitting the member to float away from the fluid flow passage such that liquid freely passes through the fluid flow passage.

In practice, it has been found that while the method significantly reduces spillage by closing off the fluid flow passage until pouring time, the buoyant member that performs this spill-preventing function by blocking the fluid flow passage of the container when the full container is squeezed also blocks a final residual portion of the fluid from exiting the container when the liquid level in the container has been drained to a level no longer sufficient to float the buoyant member away from the fluid flow passage. Residual liquid remaining in the container, particularly liquid tending to cling to the container walls due its viscosity characteristic, therefore remains inside the container, defining a wasted fraction of the original liquid supply and creating environmental and disposal concerns in the case of a hazardous or pollutant liquid.

It is therefore desirable to provide an improved method for reducing spillage during pouring of a liquid from a container that reduces the amount of residual liquid left behind in the container, or in other words increases the overall fraction of the liquid released from the container, relative to prior art pouring methods.

SUMMARY OF THE INVENTION

According to a first aspect of the present invention, there is provided a method of reducing spillage and residual liquid when pouring liquid out of a container which includes the following steps. Firstly, place a free floating buoyant member into a resilient deformable container adapted for containing liquid. The liquid is of greater density than the density the member such that the member floats upon the surface of the liquid. The container has a fluid flow passage narrower than the dimensions of the member such that the member is prevented from exiting through the fluid flow passage. Secondly, exert a force to temporarily deform the container thereby reducing the volume of an inner cavity thereof and causing the liquid in the container to press the member into a position sealing the fluid flow passage. Thirdly, invert the container thereby placing the container into a pouring position. Fourthly, release the force upon the container such that the container resiliently resumes its original shape thereby increasing the volume of the inner cavity and permitting the member to float away from the fluid flow passage such that liquid freely passes through the fluid flow passage. Fifthly, continue to freely pass liquid through the liquid flow passage with the container inverted until fluid within the container approaches or reaches a level no longer sufficient to keep the member floating at a distance spaced entirely from the fluid flow passage. Sixthly, while keeping the container inverted, prevent the member from becoming or remaining fully seated at the position sealing the fluid flow passage to allow residual fluid remaining in the container to pass through the fluid flow passage during shaking of the container.

It is preferred that a round ball be used as the buoyant member, as other shapes can present difficulties in seating in a sealing position. When the described method is used, the ball seals the fluid flow passage to prevent liquid from exiting the container, as the container is inverted. Once the container is inverted and the radial inward pressure on the sidewalls of the container is released, the ball floats out of a sealing position allowing liquid to flow. The method improves on the prior art by taking the further step of preventing the ball from becoming or remaining seated at its sealing position closing off the passage after most of the liquid has left the container, so that residual liquid left therein is not blocked from exiting by the seated ball.

Preferably the sixth step comprises inducing movement of the ball to keep the member from coming to rest at the fluid flow passage or to dislodge the member from the fluid flow passage if already seated therein.

Inducing motion of the member may comprise shaking the container.

Inducing motion of the member may comprise forcing an impact between the container and another object.

The object may be stationary, and accordingly, inducing motion of the member may comprise knocking the container against the object.

The step of releasing the force on the container is preferably carried out over an object to which the liquid is to be distributed, and inducing motion of the member may in this case comprise knocking the container against a component of the object.

The liquid may comprise engine oil, with the object comprising an engine and the component comprising an oil inlet port through which the fluid enters the engine.

The resilient deformable container preferably comprises a first pair of opposed concave sidewalls, such that the member is positionable blocking the fluid flow passage by exerting a radial inward force upon the concave sidewalls; and a second pair of convex sidewalls, such that in the event of a pressure lock occurring, which holds the member in position blocking the fluid flow passage, the member is releasable from the fluid flow passage by exerting a radial inward force upon the second pair of sidewalls, thereby deforming the container to force the concave sidewalls outwardly, thus permitting the member to float away from the fluid flow passage such that liquid freely passes through the fluid flow passage.

The sixth step may comprise repeatedly exerting and releasing radial inward forces upon the second pair of sidewalls to repeatedly unseat the member from the position sealing the fluid flow passage and allow the residual fluid to pass therethrough while the member is unseated.

According to a second aspect of the invention, there is provided a container that includes a resilient deformable body having a liquid impervious inner cavity and a pouring end that defines an opening communicating with the inner cavity. A restriction piece has a fluid flow passage extending therethrough that is smaller than the opening of the resilient deformable body, the restriction piece being arranged to engage the resilient deformable body in a manner sealing therewith adjacent the open end thereof to communicate the fluid flow passage with the inner cavity and form a restriction in a fluid pathway from the inner cavity through opening of the pouring end. A ball is sized to fit within the inner cavity of the resilient deformable body and has a diameter larger than the restriction formed in the fluid pathway by the restriction piece.

The two piece construction of the container allows the ball to be inserted before final assembly of the two pieces together to define the completed container. This way, a ball too large to fit through the fluid flow passage even when compressed can be used. Use of a larger ball size to passage size ratio means that the ball sits less deep within the fluid flow passage during sealing thereof, and therefore is easier to dislodge from the sealing position closing off the passage by shaking or impacting the inverted container once the container has been emptied to a level where the ball no longer floats from the sealing position, but residual liquid remains within the inner cavity.

The restriction piece may comprise a bushing sized to be inserted into the resilient deformable body through the opening and fit concentrically within and against the resilient deformable body adjacent the pouring end. In this case, the resilient deformable body may comprises a neck that defines the pouring end thereof and into which the bushing is inserted.

Alternatively, the restriction piece may comprise an extension arranged to connect to the resilient deformable body adjacent the open end thereof to project and narrow away from the open end of the resilient deformable body to define a neck of the container.

According to a third aspect of the present invention, there is provided a method of producing a container for reducing spillage and residual liquid, the method including firstly providing a resilient deformable body defining an inner cavity and having a pouring end defining an opening and providing a restriction piece through which a fluid flow passage extends, the fluid flow passage being smaller than the opening of the resilient deformable body. Next, a free floating buoyant member is placed into the inner cavity of the resilient deformable body. The restriction piece is engaged with the resilient deformable body in a manner sealing therewith adjacent the open end thereof to communicate the fluid flow passage with the inner cavity and form a restriction in a fluid pathway extending from the inner cavity through opening of the pouring end. Before or after this connection of the restriction piece to the deformable body, a fluid of greater density than the member is poured into the inner cavity.

According to a fourth aspect of the present invention, there is provided a container which includes a resilient deformable body having a liquid impervious inner cavity. A free floating buoyant ball is disposed within the inner cavity. A fluid flow passage communicates with the inner cavity. The fluid flow passage is smaller than a diameter of the bail, thereby confining the ball within the container. The ball and the fluid flow passage are sized and shaped such that less than one third of a circumference of a circle defined by the ball in a diametral plane thereof sits within the fluid flow passage when the ball is in a position sealing off the fluid flow passage from the inner cavity.

According to a fifth aspect of the present invention, there is provided a container which includes a resilient deformable body having a liquid impervious inner cavity. A free floating buoyant ball is disposed substantially within the inner cavity. A fluid flow passage communicates with the inner cavity and confines the ball within the container. The ball and the fluid flow passage are sized and shaped to allow seating of ball at the fluid flow passage in a position sealing off the fluid flow passage from the inner cavity. The ball has a diameter $d_{ball}$ and the fluid flow passage has a diameter $d_{passage}$, and the diameter $d_{passage}$ of the fluid flow passage at an end thereof where the ball seats to seal off the fluid flow passage is less than) $d_{ball} \sin(60°)$.

The relative sizing of the ball and fluid passage outlined above seats the ball further out of the fluid flow passage when situated in the sealing position than in the prior art, the benefit of which having been briefly outlined above.

BRIEF DESCRIPTION OF THE DRAWINGS

In the accompanying drawings, which illustrate exemplary embodiments of the present invention.

DETAILED DESCRIPTION

Figure 11:
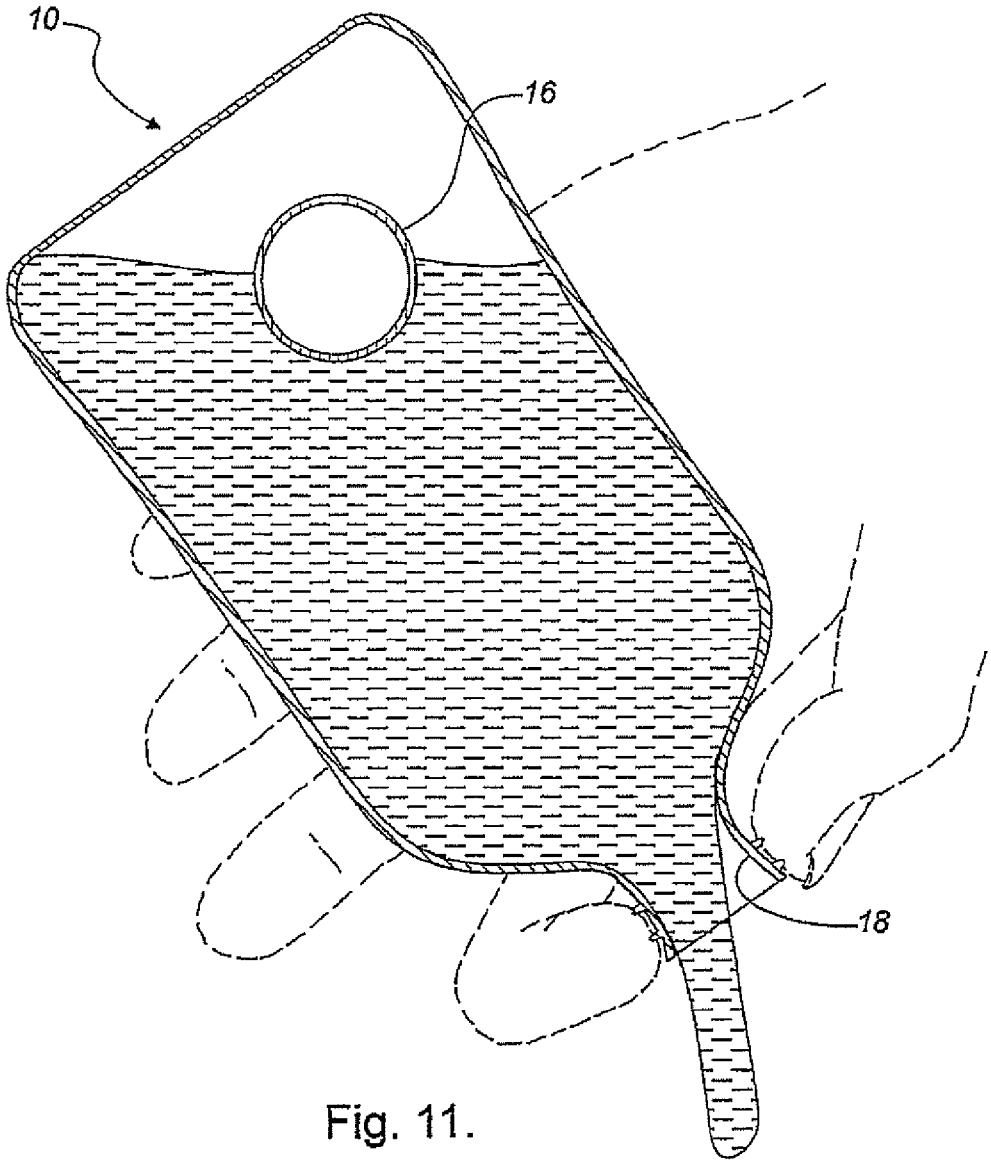
FIG. 11 is a front elevation view in longitudinal section of the container illustrated in FIG. 10, with the fluid flow passage deformed to break the pressure lock condition.
Figure 12:
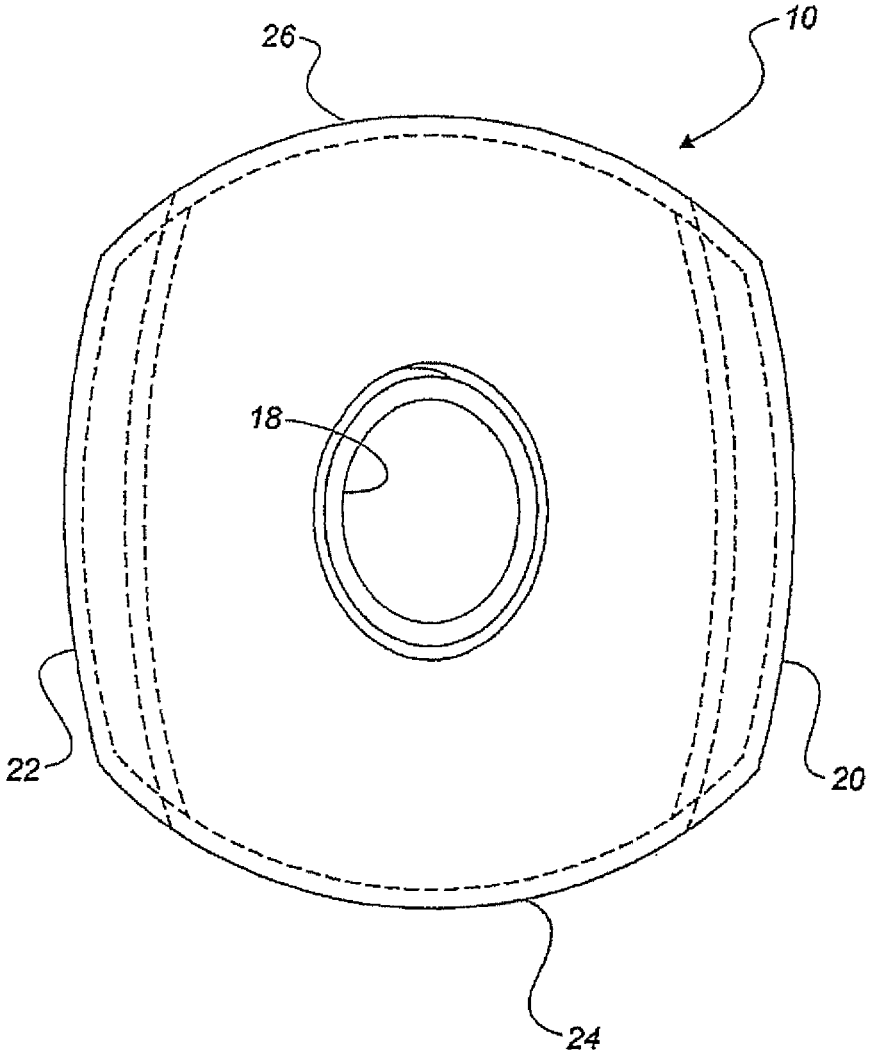
FIG. 12 is a top plan view of the container illustrated in FIG. 11, with the fluid flow passage deformed.
Figure 13:
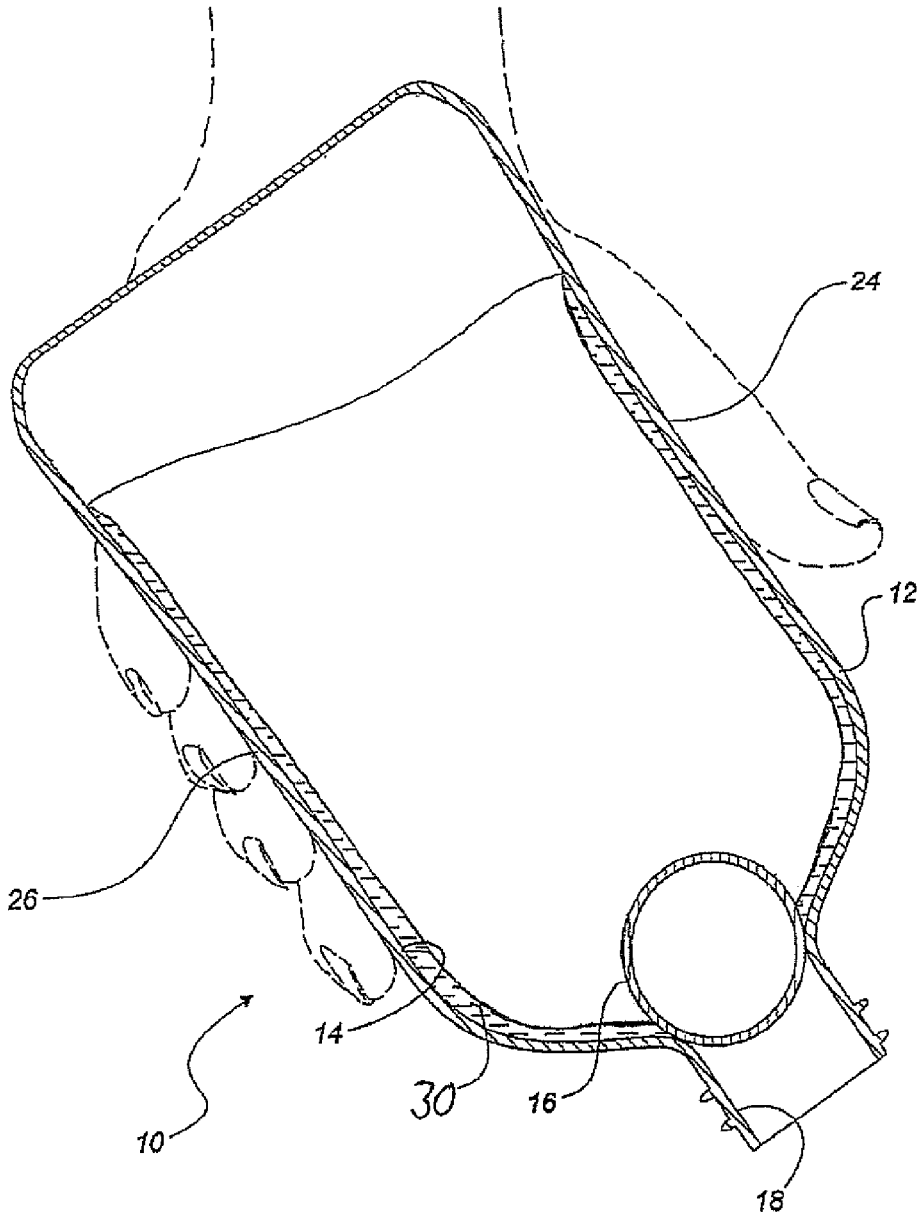
FIG. 13 is a front elevation view in longitudinal section of the container illustrated in FIG. 1, in which the container has been substantially emptied except for a residual amount of fluid.
Figure 14:
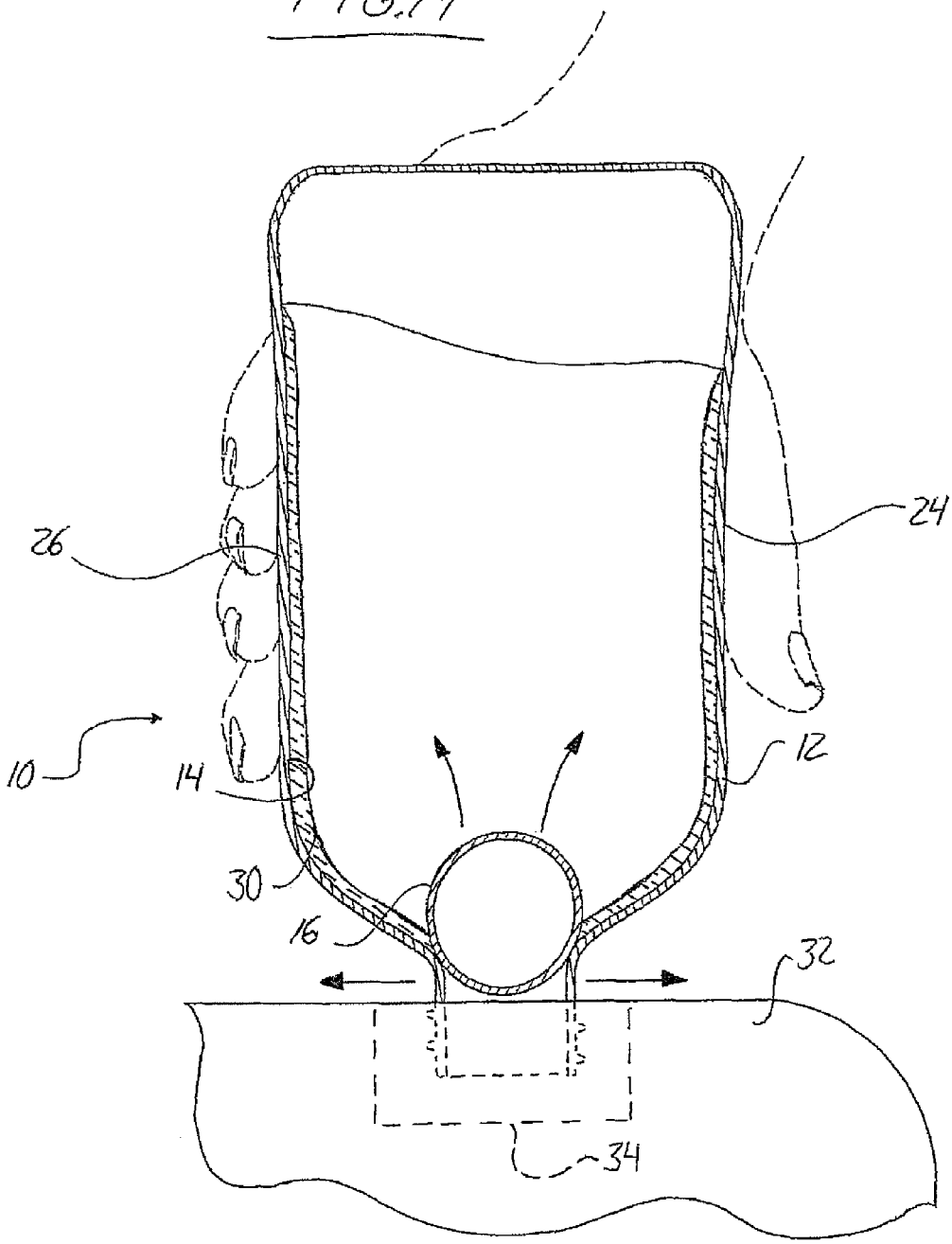
FIG. 14 is a front elevation view in longitudinal section of the container illustrated in FIG. 13, illustrating knocking of the fluid flow passage against edges of an inlet port of a schematically illustrated object receiving the fluid in order to reopen the fluid flow passage for access by the residual fluid.
Figure 15:
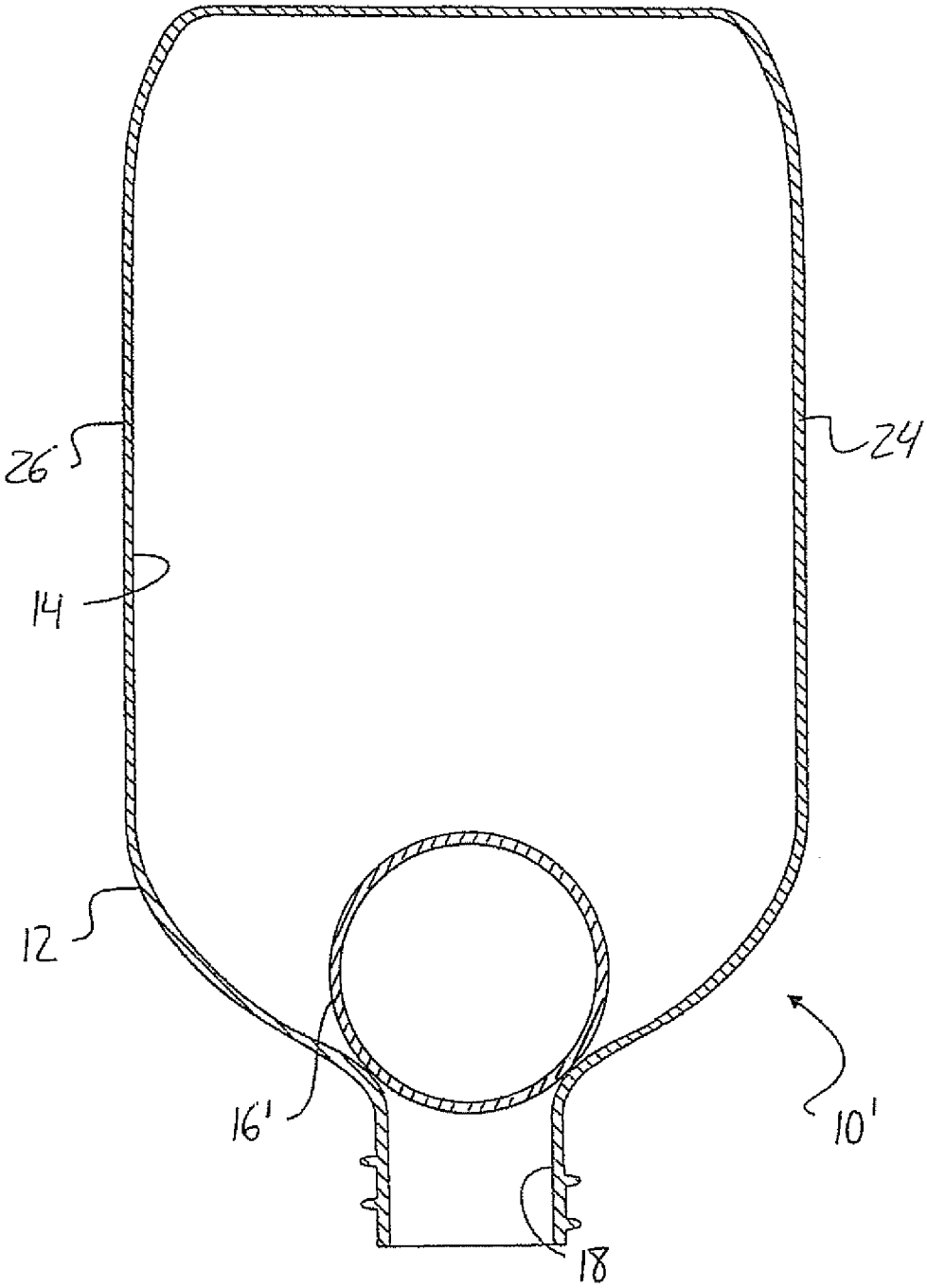
FIG. 15 is a front elevation view in longitudinal section of a container having its fluid flow passage and passage sealing member sized to ease unseating of the member from the fluid flow passage for draining of the residual fluid from the container.

FIGS. 1 to 12 show the container of Applicant's prior patent and illustrate method steps and container features compatible with the new and improved methods of the present application. Description of these features and steps is reproduced herein below for convenient reference. FIG. 13 illustrates a drawback in the prior art method, in that once most of the liquid has been poured from the container such that the ball is no longer floated away from its sealing position seated against and closing off the fluid flow passage, residual liquid coating the interior wall surfaces of the container is blocked from reaching the fluid flow passage and exiting the container by the seated ball. FIG. 14 illustrates how a new additional step in the methods of the present invention dislodges the seated ball, or prevents it from seating in the first place, to allow the residual liquid to flow through the fluid flow passage to its intended destination, for example by shaking, impacting or knocking the container while still inverted to reverse or prevent the seating from the ball in the sealing position at the fluid flow passage. FIG. 15 illustrates an advantageous embodiment of the present invention in which the container and ball are configured to better ensure that such dislodgement of the ball can be readily achieved to free the residual liquid from the container to minimize waste.

Figure 1:
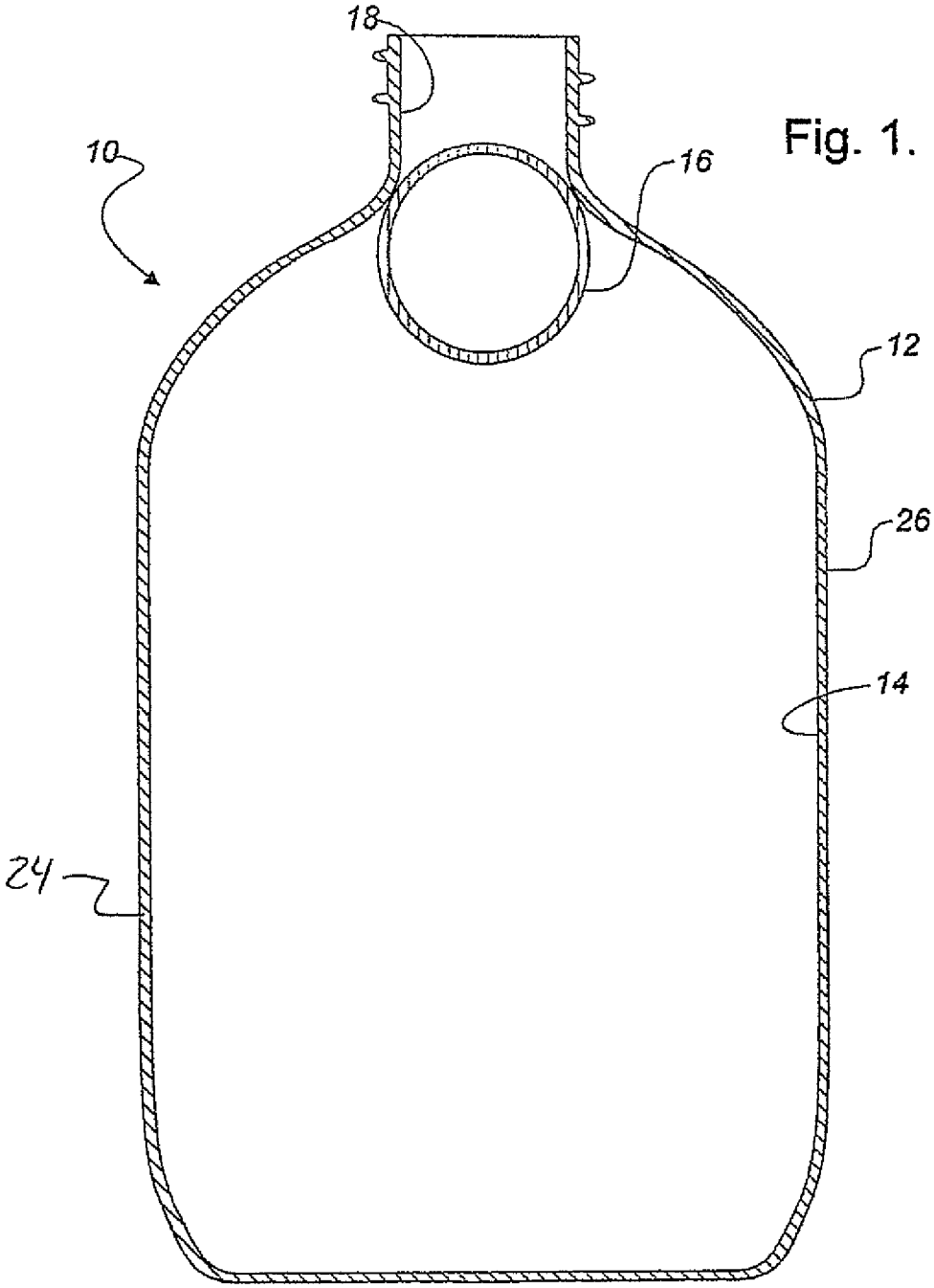
FIG. 1 is a front elevation view in longitudinal section of a container.
Figure 2:
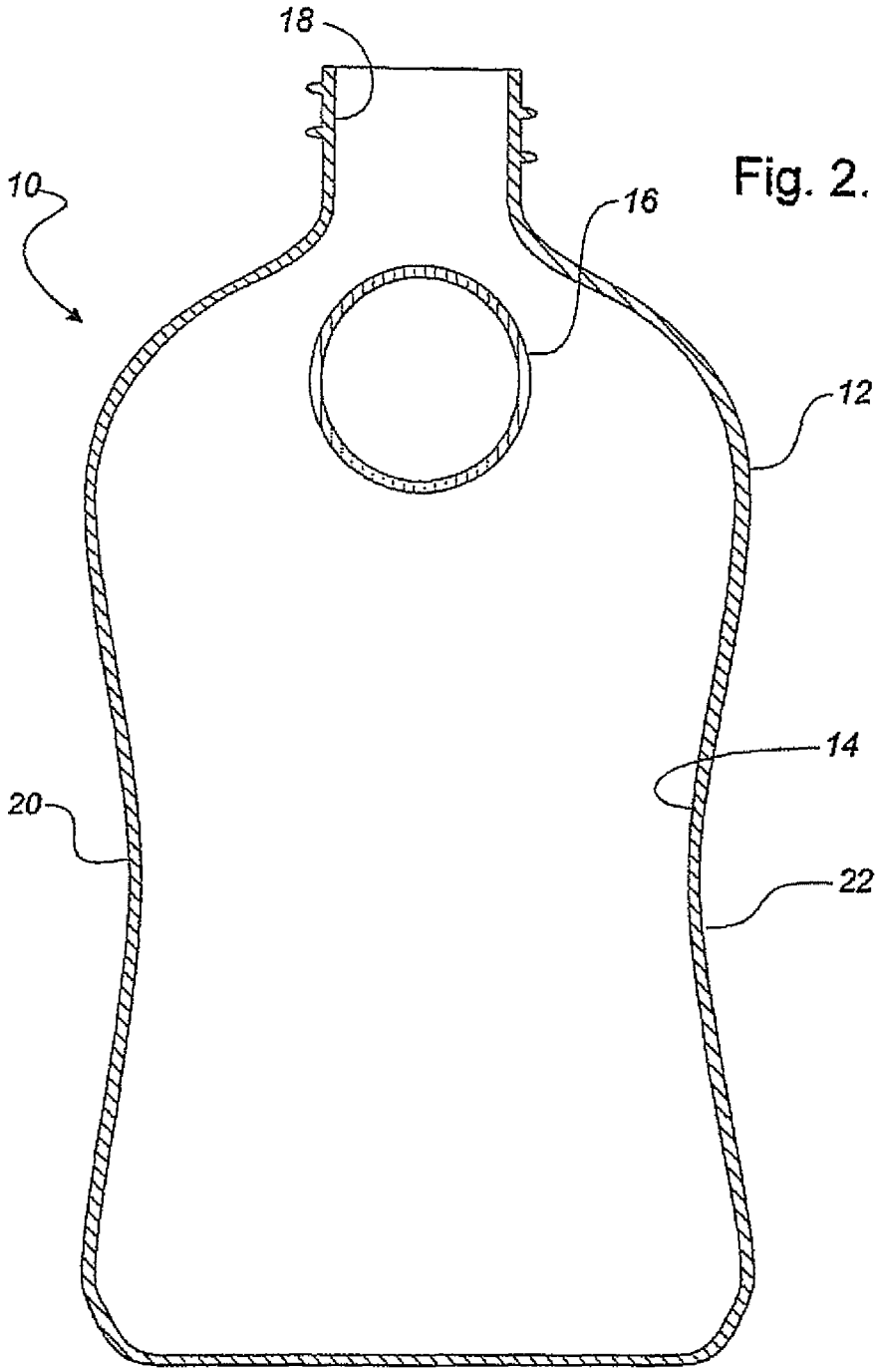
FIG. 2 is a side elevation view in longitudinal section of the container illustrated in FIG. 1.
Figure 3:
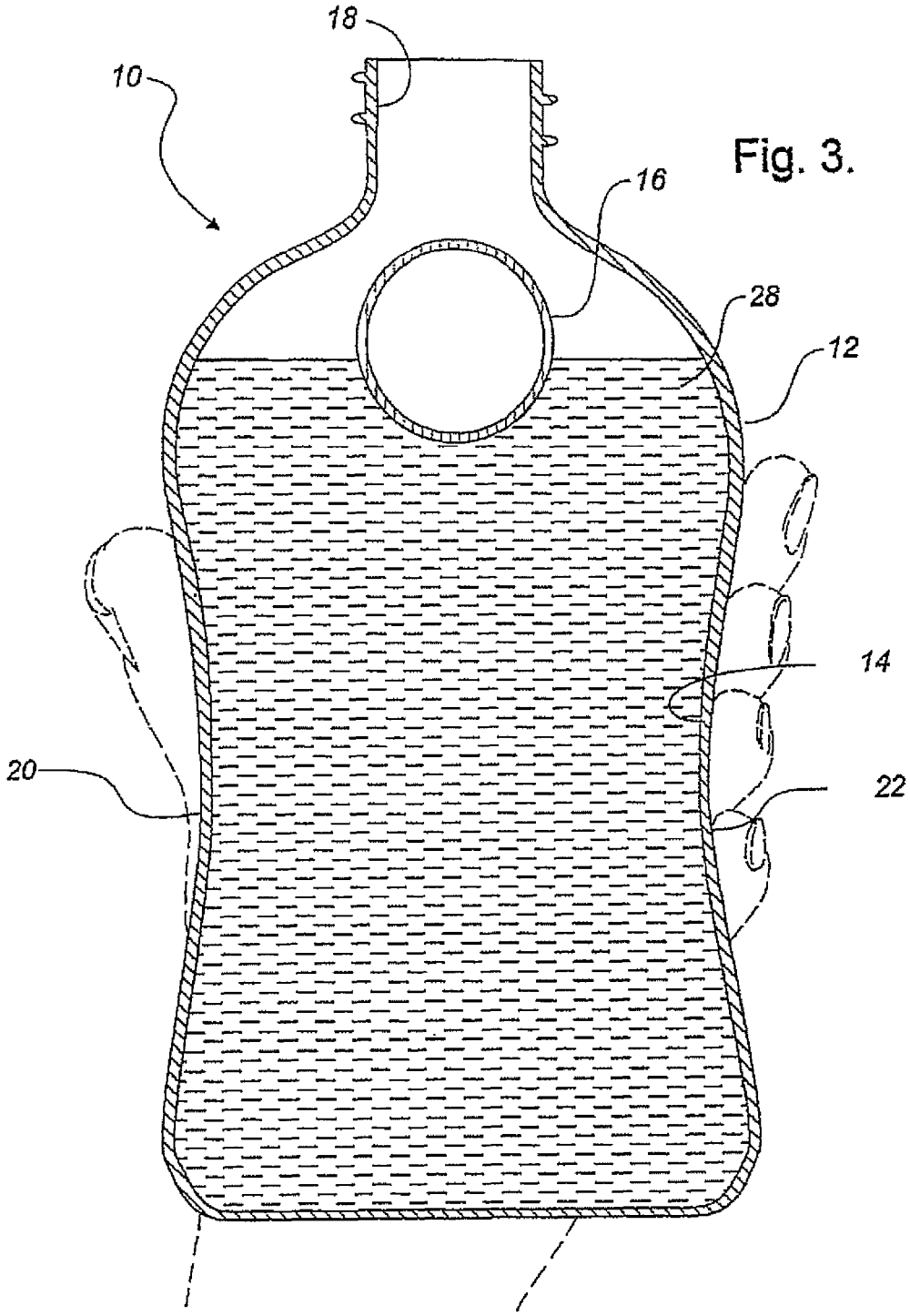
FIG. 3 is a side elevation view in longitudinal section of the container illustrated in FIG. 1, filled with liquid.
Figure 4:
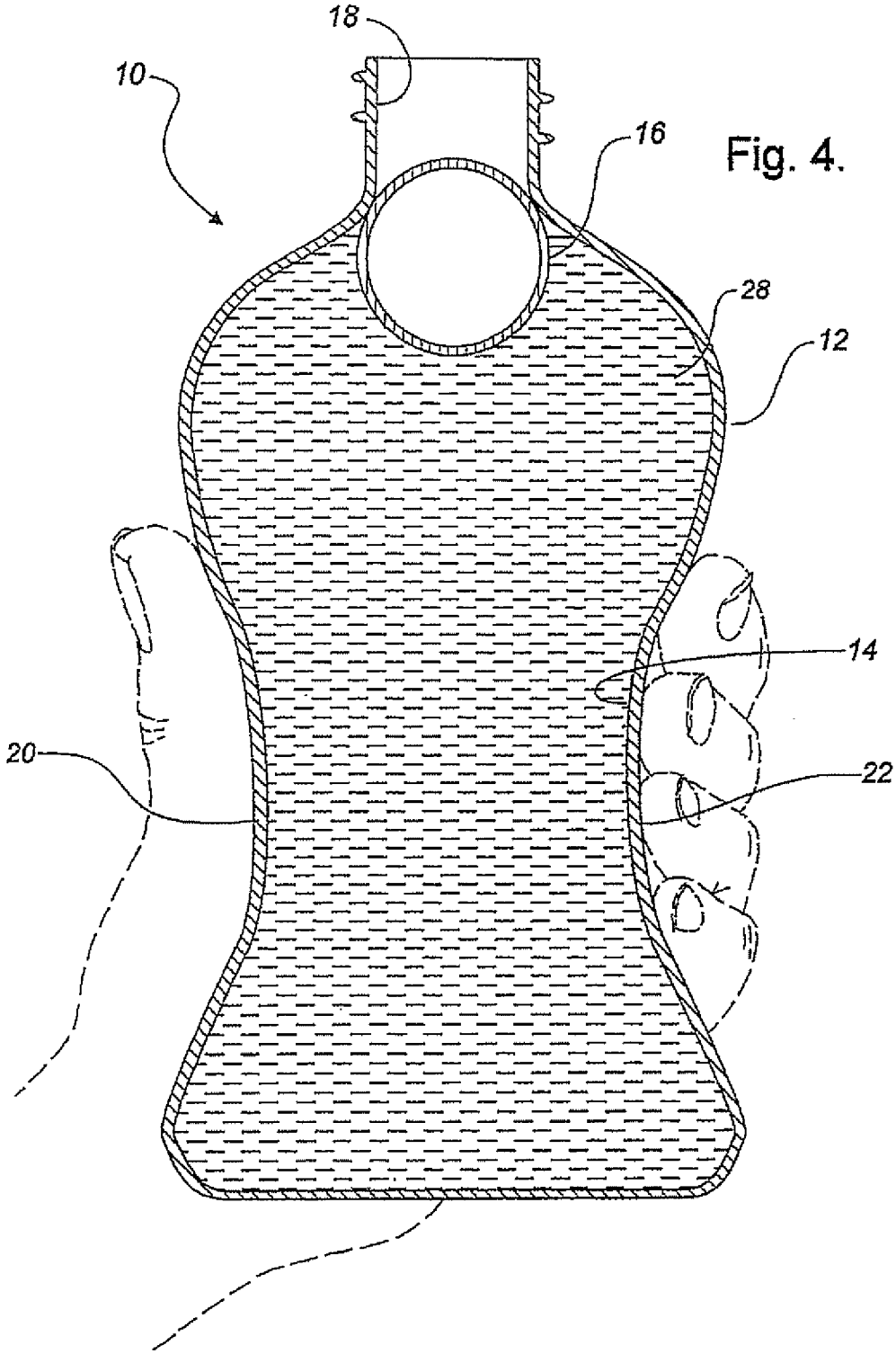
FIG. 4 is a side elevation view in longitudinal section of the container illustrated in FIG. 1, with an inward radial force being exerted.
Figure 5:
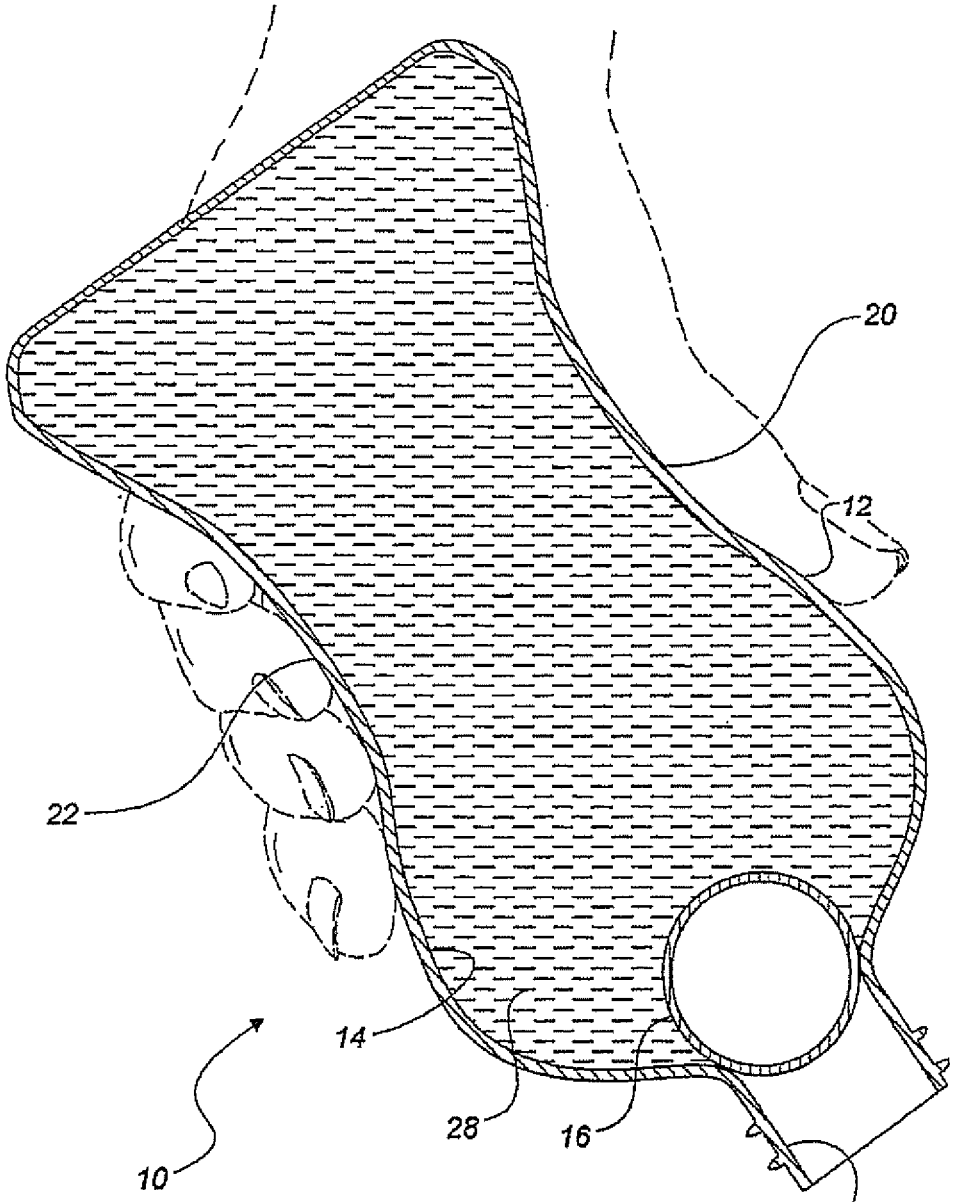
FIG. 5 is a side elevation view in longitudinal section of the container illustrated in FIG. 1, inverted.
Figure 6:
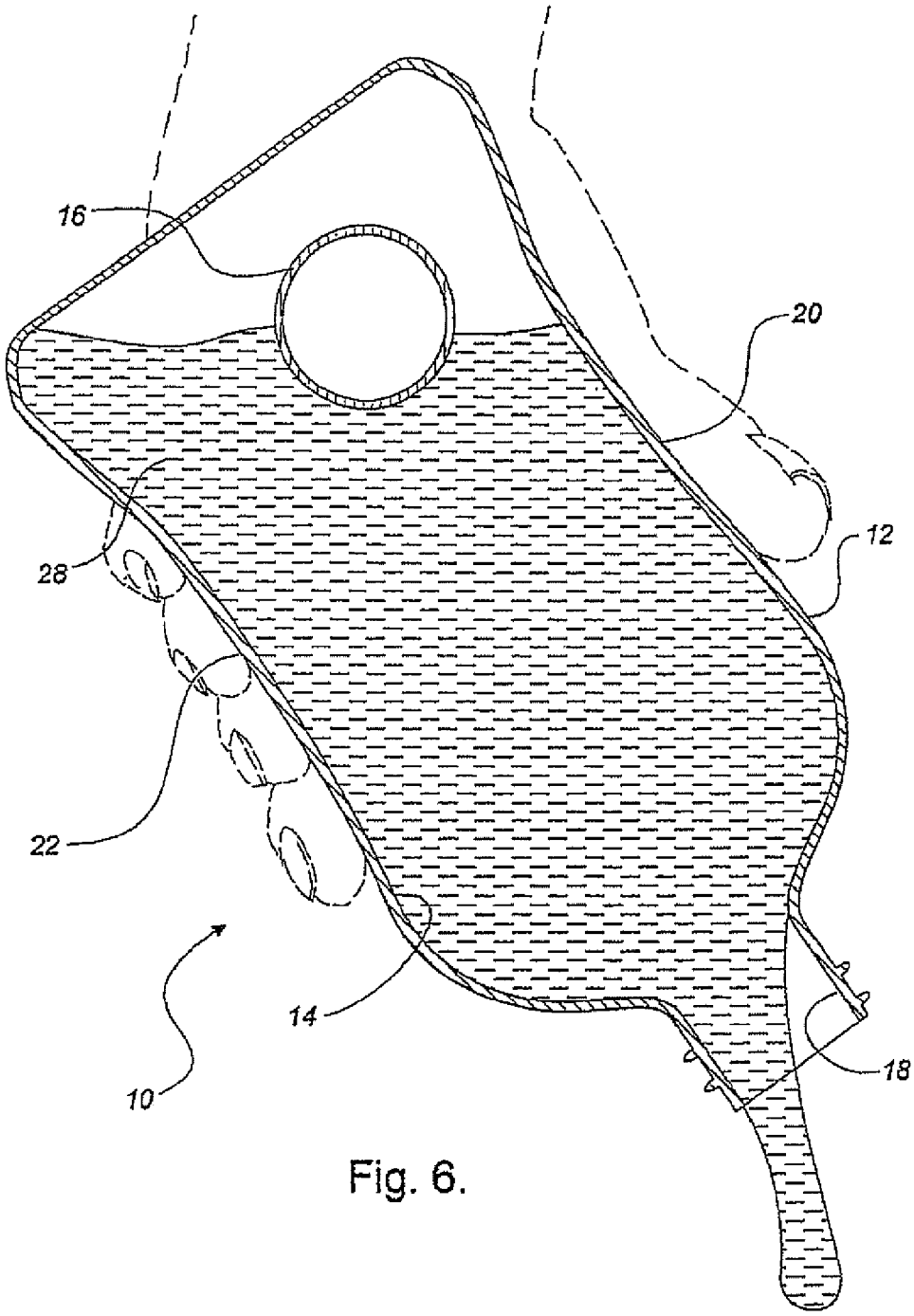
FIG. 6 is a side elevation view in longitudinal section of the container illustrated in FIG. 1, with liquid flowing.
Figure 9:
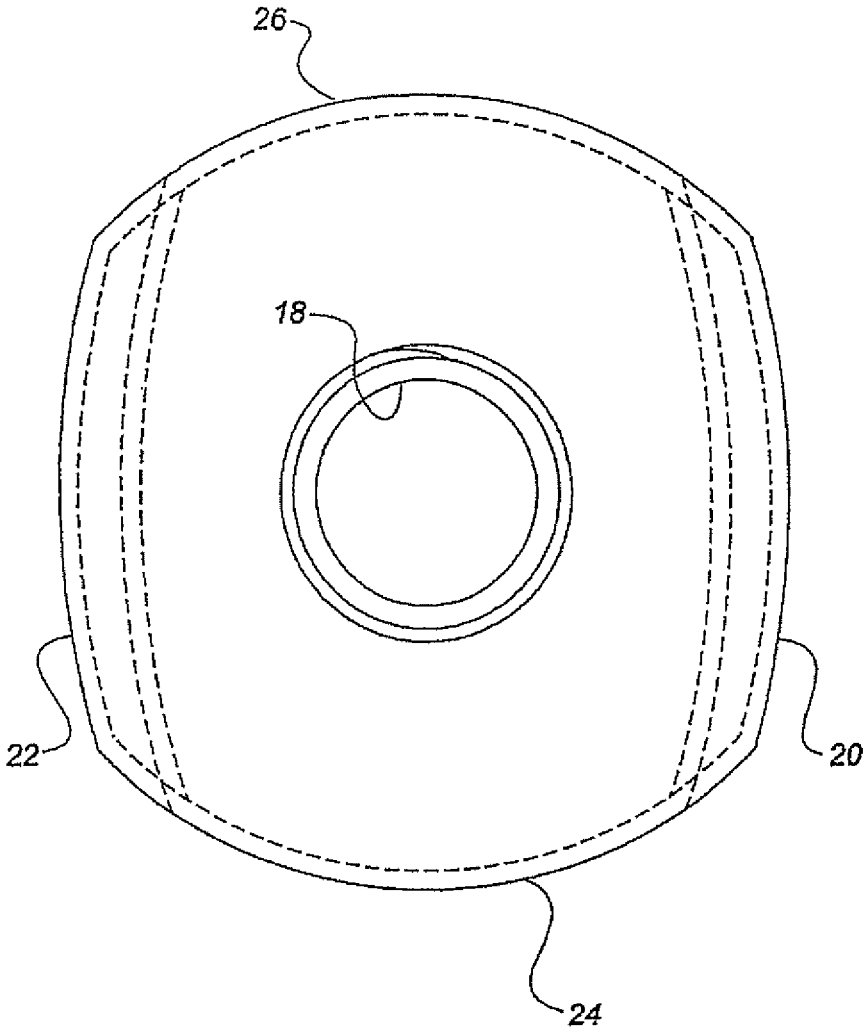
FIG. 9 is a top plan view of the container illustrated in FIG. 1.

Referring to FIGS. 1 and 2, container 10 has a resilient deformable body 12. It is envisaged that body 12 would be manufactured from a polymer material, although there are other materials having suitable properties which are liquid impervious. Body 12 has an inner cavity 14. A buoyant member, in the form of ball 16, is disposed within inner cavity 14. It must be emphasized that ball 16 must be free floating or it will create problems in using container 10 in accordance with the preferred method. A annular fluid flow passage 18 communicates with inner cavity 14. Fluid flow passage 18 is smaller in diameter than ball 16, in order to ensure that ball 16 is confined within inner cavity 14. There are a number of ways of placing ball 16 within inner cavity 14. Ball 16 can be deformable and forced under pressure through fluid flow passage 18 after fabrication of body 12, or ball 16 can be inserted as part of the fabrication process. Referring to FIG. 9, it is preferred that body 12 have a first pair of generally concave sidewalls 20 and 22, and a second pair of generally convex sidewalls 24 and 26.

The use of container 10 in accordance with the preferred method will now be described with reference to the figures. Firstly, referring to FIG. 3, buoyant ball 16 is placed into resilient deformable body 12 of container 10 adapted for containing liquid, generally indicated by reference numeral 28. Liquid 28 should be of greater density than the density ball 16 such that ball 16 floats upon the surface of liquid 28. As previously stated, fluid flow passage 18 of container 10 is narrower in diameter than ball 16 such that ball 16 is prevented from exiting container 10 via fluid flow passage 18. Secondly, referring to FIG. 4, exert a radially inward force upon sidewalls 20 and 22 of container 10 to temporarily deform container 10. When this is done the volume of inner cavity 14 is decreased. With the decrease in volume of inner cavity 14, air is expelled from container 10 and liquid 28 presses floating ball 16 into a position sealing fluid flow passage 18. Thirdly, referring to FIG. 5, invert container 10 thereby placing container 10 into a pouring position. It should be noted that the positioning of ball 16 prevents liquid 28 from flowing through fluid flow passage 18. Pressure must be maintained upon sidewalls 20 and 22 during throughout this step. Fourthly, referring to FIG. 6, release the force upon sidewalls 20 and 22 of container such 10. Container 10 resiliently resumes its original shape thereby increasing the volume of inner cavity 14. The resilient movement breaks the seal allowing an inflow of air into inner cavity 14 that accompanies the change in volume. The forces maintaining ball 16 in the sealing position are friction with fluid flow passage 18 and the weight of the column of liquid 28. The resilient movement of container 10 and the entry of air will, in most instances, exert sufficient force counterbalance the forces maintaining ball 16 in the sealing position. Once the forces are counterbalanced ball 16 will float away from fluid flow passage 18 enabling liquid 28 to freely pass through fluid flow passage 28.

In use as described, ball 16 seals fluid flow passage 18 to prevent liquid 28 from exiting container 10, as container 10 is inverted. Once container 10 has been inverted and the radial inward pressure on sidewalls 20 and 22 of container 10 is released, ball 16 floats out of the position sealing fluid flow passage 18 thereby allowing liquid to flow. The volume of inner cavity 14 can be altered by manipulation of the sidewalls. Radial inward pressure upon concave sidewalls 20 and 22 deforms container 10 reducing the volume of inner cavity 14, causing liquid 28 to lift ball 16 into the sealing position.

Figure 7:
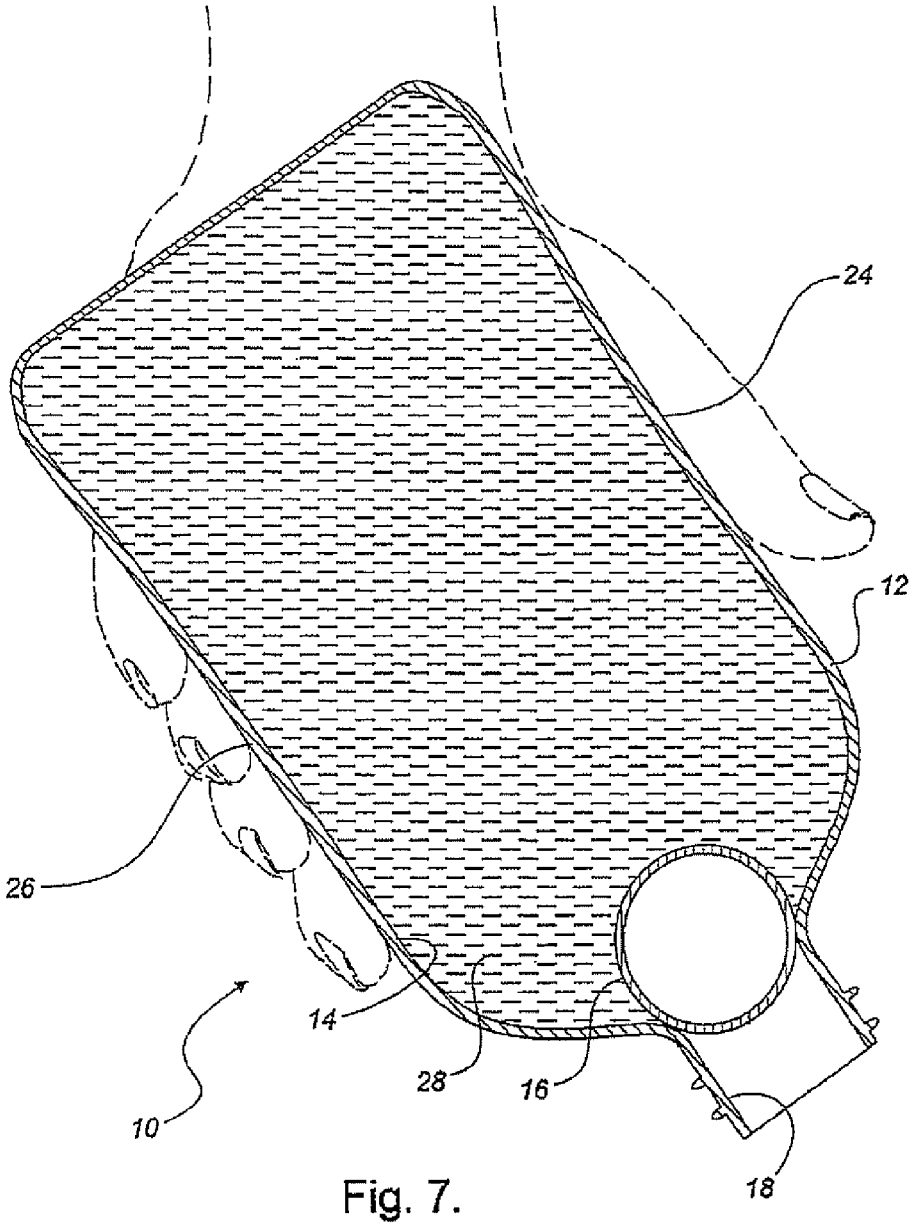
FIG. 7 is a front elevation view in longitudinal section of the container illustrated in FIG. 1, in which a pressure lock condition exists.
Figure 8:
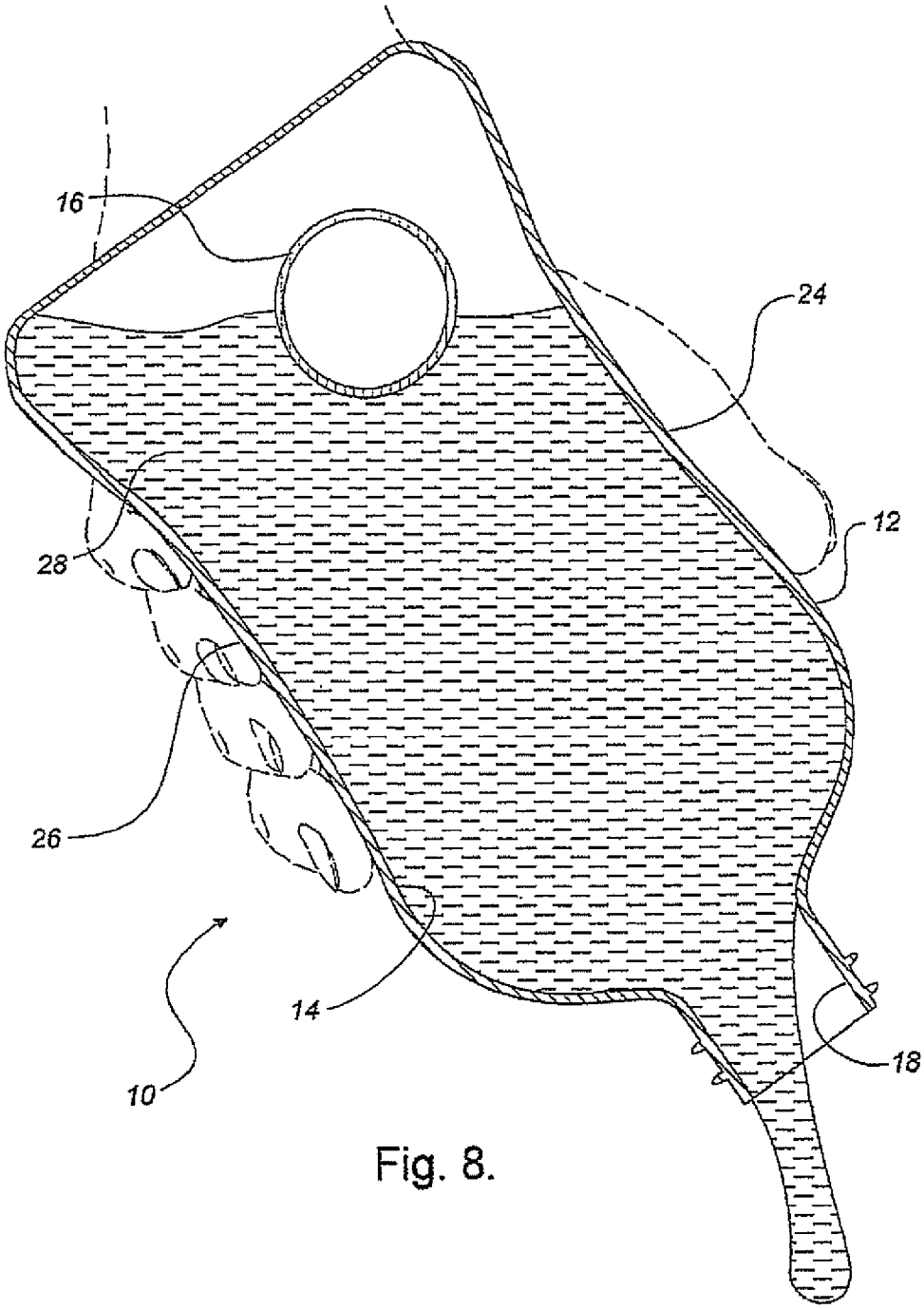
FIG. 8 is a front elevation view in longitudinal section of the container illustrated in FIG. 7, with an inward radial force being exerted to get liquid flowing.

FIGS. 7 and 8, illustrates steps which can be taken if a pressure lock occurs, that is, if the resilient movement of container 10 when radial inward pressure upon sidewalls 20 and 22 is released is not sufficient to break the seal to permit an inflow of air. When this type of "pressure lock" occurs a differential in pressure retains ball 16 in position sealing fluid flow passage 18. Ball 16 is releasable from fluid flow passage 18 by exerting a radial inward force upon second pair of sidewalls 24 and 26. The radial inward force exerted upon second pair of sidewalls 24 and 26 tends to force first pair of sidewalls 20 and 22 outwardly to break the pressure lock. Radial inward pressure upon convex sidewalls 24 and 26 deforms container 10, causing a counter pressure of incoming air that assists in releasing ball 16 from its sealing position.

Figure 10:
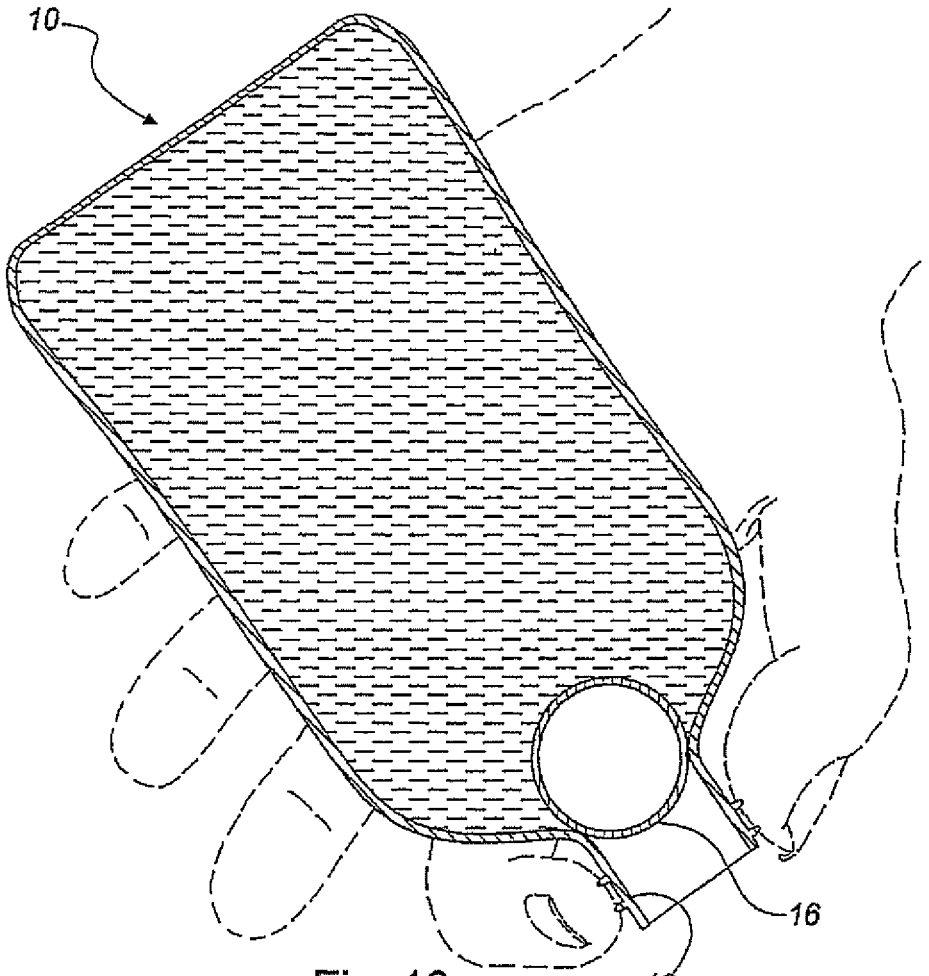
FIG. 10 is a front elevation view in longitudinal section of the container illustrated in FIG. 1, in which a pressure lock condition exists.

If fluid flow passage 18 deforms, a seal will not be maintained with ball 16. Therefore, if fluid flow passage 18 is deformable, this will provide an alternative means of breaking a pressure lock. This alternative is illustrated in FIGS. 10 through 12. FIG. 10 illustrates container 10 in which a pressure lock condition exists. FIG. 11 illustrates the manner in which one would deform fluid flow passage 18 in order to release the pressure lock condition. FIG. 12 illustrates the appearance that normally circular fluid flow passage 18 assumes when deformed. When fluid flow passage 18 is deformed, the seal is broken permitting the pressure outside the container to balance the pressure within inner cavity 14. Once the pressures are balanced the buoyancy of ball 16 causes it to float away from the sealing position. Once ball 16 is removed from the sealing position, liquid flows through fluid flow passage 18.

As shown in FIG. 13, upon completion of the foregoing steps to pour liquid from the inverted container, after removing a pressure lock if required, the liquid level in the inverted container 10 reaches a point at which the amount of liquid is no longer sufficient to lift the ball 16 from its sealing position seated against the container's interior wall surfaces at the communication of the container's fluid flow passage 18 and inner cavity 14. As a result, the residual liquid remaining within the container, illustrated as a thin coating of residual liquid 30 clinging to the container walls, cannot drain past the ball 16 into the fluid flow passage 18 for exit from the container 10. As fluid never drained from the container into the intended liquid recipient is effectively wasted product, and depending on the liquid may present environmental or health hazards if improperly discarded, an additional step is taken in the method of the present invention before the container is removed from the inverted pouring position.

The additional step is to keep the container inverted over the object to which the liquid was being poured and either prevent the ball 16 from becoming fully seated in the sealing position closing off the fluid flow passage 18 or dislodge the ball from the sealing position if it has already seated therein. This additional step is performed while continuing to manually carry the container, as shown in FIG. 14, after the previous manually carried container steps illustrated in FIGS. 5-6.

One way to perform this step is illustrated in FIG. 14, where the container 10 is shown together with the object defining a tank or enclosure to which the fluid is delivered. In the drawing, the object is embodiment by a schematic illustration of a valve cover 32 of an automobile engine into which motor oil is delivered from the container 10 through an oil inlet port 34 in the valve cover 32. The container 10 is kept in its inverted position held over the valve cover until the pouring of the motor oil has been completed to such a degree that the oil level reaches or approaches a low enough level to no longer float the ball 16 away from the fluid flow passage 18. The container 10 is lowered to position the end of the fluid flow passage opposite the inner cavity 14 within the oil inlet port 34 of the engine if it was not previously disposed therein. The container 10 is than shaken horizontally back and forth with the fluid passage still projecting into the inlet port 34 to repeatedly bang or knock the container's passage walls against the boundary, edge or lip encircling the inlet port 34 so that each impact between the container 10 and the engine keeps the ball moving, or causes the ball to move, so as to prevent the ball from becoming fully seated, or staying fully seated, in the sealing position closing off the fluid flow passage 18. This either keeps the fluid flow passage open or repeatedly reopens it so that so that the residual oil can enter the fluid flow passage and for exit from the container 10 into the engine below.

Impacting of the container 10 need not necessarily be between the container and a component of the object defining a tank or enclosure into which the liquid is intended for delivery. For example, the container 10 may be knocked or banged against another stationary object in close proximity to the inlet or open top of the fluid-receiving object, or the container may be impacted with a movable object carried the hand of the user opposite the hand in which the container 10 is being gripped. Alternatively, the user may strike the container with this other hand to induce motion of the ball from the sealing position seated at the fluid flow passage. Also, mere shaking of the container alone may be used to prevent the ball from seating or from remaining seated, without impact between the container and another physical entity. It will also be appreciated that the step of preventing the ball from becoming or remaining seated in order to empty residual fluid is not limited to the application of pouring motor oil into the oil inlet port or oil filler tube of an internal combustion engine, as the same process may be used in other pouring applications.

As an alternative to shaking, knocking, banging or impacting the container, it has been found that the step of preventing the ball from becoming or remaining fully seated in the sealing position may alternatively or additionally involve the same squeezing action as described above with reference to FIG. 8 for overcoming a pressure lock condition of the container during earlier steps in the pouring method. That is, it has been found that, with the container having been inverted into the pouring position and substantially emptied to leave only residual liquid insufficient to float the ball out of its position seated at and sealing off the fluid flow passage 18, the ball 16 is releasable from fluid flow passage 18 by exerting a radial inward force upon the second pair of sidewalls 24 and 26. This increases the container's inner volume, as, with reference to the top view of the container in FIG. 9, an inward radial force exerted on the convex sidewalls 24, 26 will tend to force the concave side walls 20, 22 outward. The increase in the container's interior volume decreases the pressure therein so that the relatively greater outside pressure tends to force the ball out of its seated position sealing off the fluid flow passage. Therefore, the container 10 may be squeezed and released in an alternating and repeating manner to exert and release such radial inward force on the convex side walls to repeatedly unseat and reseat the ball 16 from the sealing position at the fluid flow passage 18, each unseating or dislodging of the ball 16 allowing the residual fluid to pass through the fluid flow passage 18 to leave the container. The carrying out and effect of this squeezing action is made easier and amplified by the described arrangement of the container walls in a concave opposing pair and convex opposing pair.

FIG. 15 shows a container 10' that features a larger ball 16' used with the same container as the other figures so that the ball 16' does not sit as low within the fluid flow passage 18 when the container is inverted with the ball 16' seated in the sealing position closing of the fluid flow passage 18. In the container 10' of FIG. 15, only about one quarter of the circular circumference of the spherical ball's cross-section in a diametral plane lies in the fluid flow passage between and below the points in this plane on opposite sides of the fluid flow where the ball sits on the interior container surfaces. A smaller fraction of the ball's volume thus lies in or over and seals-off the fluid flow passage 18 than in the container of FIGS. 1 to 12, wherein about one third of the circular circumference of the smaller ball's cross-section in a diametral plane thereof lies in the fluid flow passage 18. The two embodiments thus differ in the ratio between the diameter of the ball, $d_{ball}$, and the diameter of the fluid flow passage, $d_{passage}$, at the end thereof at which the ball sits.

Based on one third of the diametral cross-section circumference of ball of FIGS. 1 to 12 spanning across the fluid flow passage, the angle about the ball's center spanned by ball and the fluid flow passage at the end thereof at which the ball is seated is 120°. The inner diameter of the fluid flow passage's circular cross section at where the ball is seated equals a chord of the ball's diametral cross-section spanning the 120° at this same location. Using the formula $C=2r\sin(\theta/2)$ for chord length, where θ is the angle spanned by the chord and r is the radius of the ball's diametral cross-section, and hence the radius of the ball, the diameter of the passage where the ball is seated, $d_{passage}$, can be written as:

$$d_{passage}=C=2r\sin(\theta/2)=d_{ball}\sin(\theta/2)=d_{ball}\sin(120°/2)=d_{ball}\sin)(60°)$$

Using the same formula for the container of FIG. 15, in which the about one quarter of the ball's diametral cross-section's circumreference is seated in the passage and the angle spanned by the fluid passage opening and the ball closing this opening about the ball's center is accordingly only 90°, $d_{passage}$ has a lower value, specifically:

$$d_{passage}=C=2r\sin(\theta/2)=d_{ball}\sin(\theta/2)=d_{ball}\sin(90°/2)=d_{ball}\sin)(45°)$$

The container of FIG. 15 therefore has a smaller fluid flow passage relative to the ball size, or a larger ball size relative to the fluid flow passage, relative to the container of FIGS. 1 to 12.

This reduction in the size of the ball relative to the fluid flow passage in order to reduce the fraction of the ball's overall size that seals the fluid flow passage closed improves the ease with which the ball can be dislodged from its sealing position by shaking or impact in order to drain residual fluid otherwise left in the container when the fluid level is no longer sufficient to keep the ball floating at a distance from its seat at the connection of the fluid flow passage and inner cavity. It will be appreciated that shallower seating of the ball in the fluid flow passage may alternatively or additionally be achieved through reduction of the fluid flow passage diameter at the sealing area where the ball sits while maintaining or increasing the ball diameter respectively.

Figure 16:
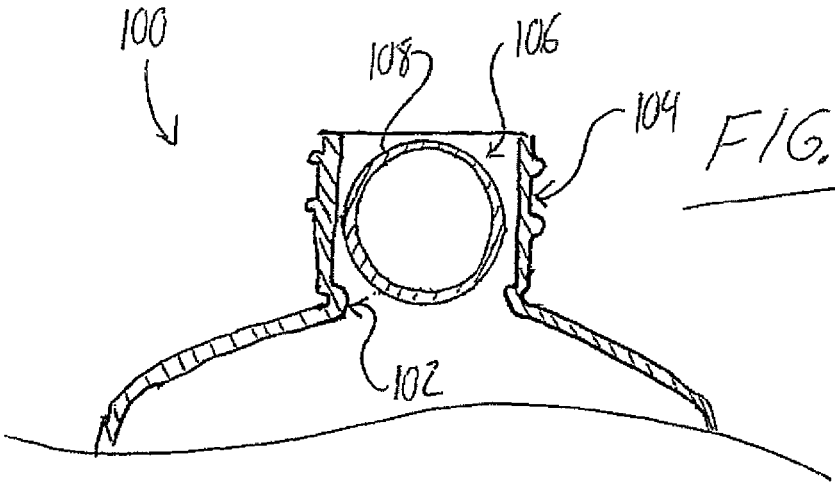
FIG. 16 is a partial front elevational view in longitudinal section of a container featuring an integral restriction at the end of the fluid flow passage during insertion of the ball into the container.
Figure 17:
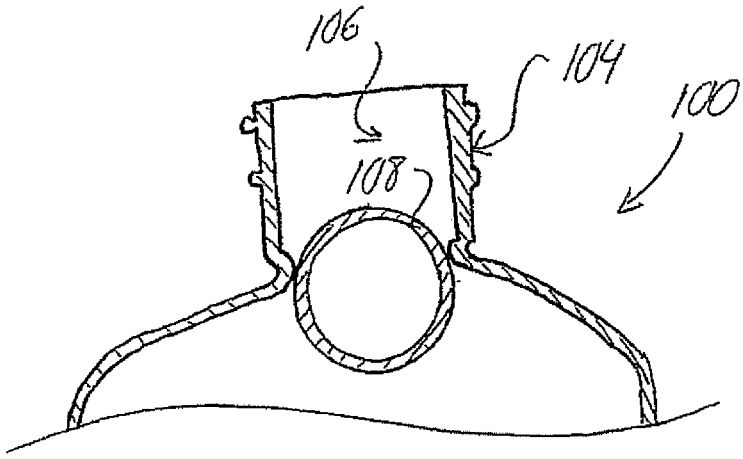
FIG. 17 is a partial front elevational view in longitudinal section of the container of FIG. 16 after insertion of the ball and inverting of the container to seat the ball at the restricted end of the fluid flow passage.

FIGS. 16 and 17 show a blow-molded container 100 shaped to form a restriction 102 where a neck 104 at the top of the container 100 projects away from the rest of the container, the restriction 102 defining a narrowest part of the container with a diameter less than that of the cylindrical neck interior 106 above it. As shown in FIG. 16, the inner diameter of the neck 104 slightly exceeds the outer diameter of a resiliently deformable, normally spherical, ball 108 to accommodate insertion of the ball in its normal spherical shape into the neck from the end thereof opposite the inner cavity of the container, but the inner diameter at the restriction 102 is slightly smaller than the outer diameter of the ball 108. To insert the ball into the inner cavity of the container 100, downward force is applied to the bail through the neck from outside the container to deform the ball and thus facilitate passage past the narrow restriction 102 into the container's inner cavity. However, the deformability of the ball is limited, and accordingly a ball beyond a certain diameter in its non-deformed spherical shape will not be movable past the restriction 102 into the container interior.

Figure 18:
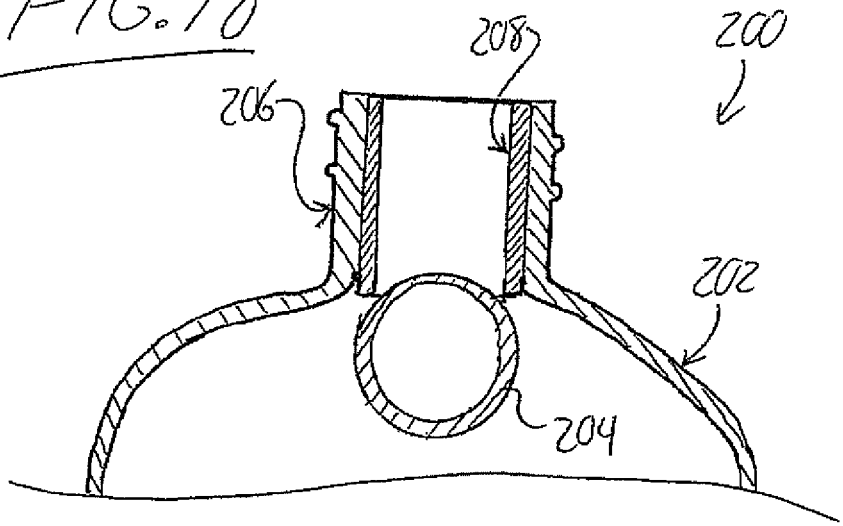
FIG. 18 is a partial front elevational view in longitudinal section of a container featuring a bushing inserted into the fluid flow passage to define a restriction therein after insertion of the ball into the container.
Figure 19:
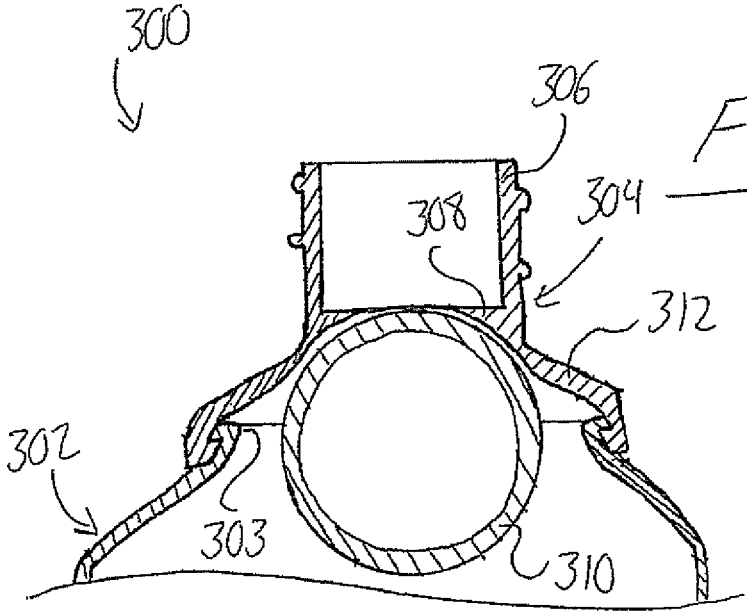
FIG. 19 is a partial front elevational view in longitudinal section of a container made up of two mating pieces fastened together in a sealing manner to enclose the ball inside.

The container 100 is thus limited to use of a ball of only slightly larger diameter than the restriction 102, and accordingly, as illustrated in FIG. 17, the ball sits relatively deep within the fluid flow passage defined by the neck 104 of the container 100 when the ball is seated in the sealing position closing off the fluid flow passage. Such deep seating of the ball is less than satisfactory for use of the container in the methods of the present invention, where easily achieved unseating of the ball from the fluid flow passage is desirable so that any user can reopen the fluid flow passage to drain residual liquid when the ball is no longer automatically floated away from the fluid flow passage. For example, with nearly half the ball of FIG. 17 being disposed in the fluid flow passage past the restriction at the inner end thereof, horizontal shaking back and forth of the container may not be sufficient to dislodge the ball from the sealing position seated against the restriction. FIGS. 18 and 19 illustrate two container constructions that overcome this limitation dictated on largeness of the ball by the size of the fluid flow passage or restriction therein.

FIG. 18 shows a two-piece container construction 200 featuring a resilient deformable body 202 having the same pair of concave side walls and pair of convex side walls as the containers of FIGS. 1 to 14. As in these other containers, the container 200 features a floating ball 204 contained in the inner cavity of the resilient body 202, which features a neck 206 of a hollow generally cylindrical shape having exterior threads for cooperation with an internally threaded screw-off cap and a generally smooth cylindrical interior communicating the container's inner cavity with the surrounding outside environment. The container 200 differs from those of FIGS. 1 to 14 however, in that the outer diameter of the ball 204 is less than the inner diameter of the neck's normally circular cross-section, and differs from the containers of FIGS. 16 and 17 in that the neck features no restriction, and instead is of uniform cross-section along the full length of the neck. As a result, the ball can simply be inserted into the container's inner cavity by dropping it through the neck. To complete the container's preparation for use in the method of the present invention after insertion of the ball however, a bushing 208 is then fitted into the container neck 206 through the open end thereof opposite the inner cavity. The bushing 208 is sized to sealingly engage its outer cylindrical surface against the inner cylindrical surface of the container neck 206. The cylindrical bore passing through the bushing is less than the diameter of the ball 204 and accordingly defines the fluid flow passage of the container 200 through which liquid can flow when the ball 204 is not seated in a sealed manner against the inner end of the bushing at the inner end at the connection of the neck 206 with the rest of the container body. The size of the ball that can be received in the container is limited not by the size of the final fluid flow passage, but rather by the size of the neck interior defining the opening at the pouring end of the container body. The bushing acts as an insert that fits entirely within the neck of the container body to form a restriction or reduction in diameter of a fluid pathway from the container body's inner cavity to the outside environment through the container body's opening at the pouring end.

FIG. 19 shows another two-piece container construction 300 featuring a resilient deformable body 302 having the same pair of concave side walls and pair of convex side walls as the containers of FIGS. 1 to 14, but lacking an integral neck. Instead, the container body 302 defining the interior cavity simply stops at a top end 303 thereof at a point before where the other containers finish narrowing to a cylindrical and threaded portion of a cap-receiving neck, and leaves a hole or opening communicating with the inner cavity at this top end 303 of the container body 302. An extension piece 304 that engages to the container body 302 at the open top end thereof instead defines a neck 306 of the container 300 at a short distance spaced above the container body's open top end. The neck has the same generally cylindrical hollow structure with external threads and interior bore as the other illustrated containers, but with an interior flange 308 projecting into the neck's interior at the bottom end thereof nearest the inner cavity of the container body 302 to form a restriction of the fluid pathway from the inner cavity of the container body to the outside environment through the open top end of the container body and the neck interior communicating therewith. The ball 310 has an outer diameter that is larger than the inner diameter of the neck and larger than the inner diameter of the flange that defines the narrowest point along the fluid pathway, but is smaller than the opening at the top end 303 of the container body 302. The ball 310 is thus placed within the interior cavity of the container body 302 prior to installation of the extension piece 304 so that the size of the ball is limited by the size of the opening at the top of the container body and not by the smaller diameter neck interior or smaller diameter of the restriction against which the ball seats to seal off the fluid flow passage defined by the extension piece 304.

The extension piece 304 is connected, for example mechanically or adhesively, to the container body 302 after insertion of the ball 310 into thereinto. The container of FIG. 19 features a shroud portion 312 that integrally flares downward and outward from the bottom end of the neck fully therearound to carry downward depending annular snap-fit catch 314 that cooperates with a respective annular snap-fit catch 316 formed at the top end 303 of the container body 302 to provide latching of the extension piece 304 onto thereonto. An injection molded extension piece 304 may be used in combination with a blow molded container body 302 to take advantage of the higher accuracy internal finish achievable in injection molding in order to provide a more accurate seating surface for the ball 310 at the restricted bottom end of the fluid flow passage defined by the neck interior where the neck connects to the shroud portion that provides an extension inner cavity of the container body at the open top end thereof. The extension piece may be produced without the flange, instead relying on a small enough inner diameter of the neck to provide shallow seating of the ball in the neck, and embodiments of the piece that include the flange need not necessarily have a neck inner diameter smaller than the ball diameter.

The container constructions of FIGS. 18 and 19 thus allow use of increased ball size to fluid passage size ratios in containers suitable for use in methods of the present invention in order to seat the ball relatively shallow in the fluid flow passage when performing sealing off thereof so that the ball can be more easily displaced from the sealing position to empty residual liquid from the container. A method of preparing or producing a spill and residual liquid reducing container, or an initial step in a spillage and residual liquid reducing pouring method, may therefore feature insertion of a ball into the container body through the open top end thereof and subsequent connection of the bushing or extension piece to the container body in a manner sealing thereto adjacent the open top end thereof so that the bushing or extension piece forming the fluid passageway also forms a restriction in a fluid pathway extending from the container body's inner cavity through the container's open end to the environment outside the container. The ball's diameter exceeds the size of the restriction and therefore is kept within the container during the method for reducing spillage and residual liquid, and may also advantageously also exceed the size of the fluid passage, yet fit inside the container due to its initial two piece construction.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of reducing spillage when pouring liquid out of a container, the method comprising the following steps:

(a). firstly, providing a free floating buoyant member situated in a resilient deformable container adapted for containing liquid, the liquid being of greater density than the density of the member such that the member floats upon the surface of the liquid, the container having a liquid flow passage narrower than the dimensions of the member such that the member is prevented from exiting through the liquid flow passage;

(b). secondly, exerting a force to temporarily deform the container thereby reducing the volume of an inner cavity thereof and causing the liquid in the container to press the member into a position sealing the liquid flow passage;

(c). thirdly, while manually carrying the container, inverting the container thereby placing the container into a pouring position; and (d). fourthly, while continuing to manually carry the container, releasing the force upon the container such that the container resiliently resumes its original shape, thereby increasing the volume of the inner cavity and causing the member to float away from the liquid flow passage such that liquid freely passes through the liquid flow passage;

(e). fifthly, while continuing to manually carry the container, continuing to freely pass liquid through the liquid flow passage with the container inverted until liquid within the container approaches or reaches a level no longer sufficient to keep the member floating at a distance spaced entirely from the liquid flow passage, leaving only a thin coating of residual liquid clinging to one or more walls of the container;

(f). sixthly, while continuing to manually carry the container, and while keeping the container inverted after completion of steps (a) through (e), applying a force to the container to induce movement of the buoyant member and thereby prevent the member from becoming or remaining fully seated at the position sealing the liquid flow passage to allow the residual liquid to drain from the container through the liquid flow passage; and (g). seventhly, while continuing to manually carry the container, and having successfully prevented the member from becoming or remaining fully seated at the position sealing the liquid flow passage in step (f), continually applying repeated forces to the container to keep the member from coming to rest and to continually maintain move the member within the container and thereby continually maintain open the liquid flow passage and achieve further draining of the residual liquid from the container therethrough.

2. The method as defined in claim 1 wherein steps (f) and (g) comprise continually shaking the container.

3. The method as defined in claim 1 wherein steps (f) and (g) comprise continually forcing impacts between the container and another object.

4. The method as defined in claim 3 wherein the object is stationary and steps (f) and (g) comprise continually knocking the container against the object.

5. The method as defined in claim 1 wherein step (d) is carried out over an object to which the liquid is to be distributed steps (f) and (g) comprise continually knocking the container against a component of the object.

6. The method as defined in claim 5 wherein the liquid comprises engine oil, the object comprises an engine and the component comprises an oil inlet port through which the liquid enters the engine.

7. The method as defined in claim 1 wherein the resilient deformable container comprises a first pair of opposed sidewalls and a second pair of opposed sidewalls and wherein step (g) comprises continually exerting and releasing radial inward forces upon the second pair of sidewalls to continually unseat and reseat the member from the position sealing the liquid flow passage to achieve the further draining of the residual liquid while the member is unseated.

8. The method according to claim 7 wherein the first pair of opposed sidewalls are concave and the second pair of sidewalls are convex.

9. The method as defined in claim 1 wherein the buoyant member is a ball.

10. The method as defined in claim 1 wherein step (a) comprises:

(i) providing a resilient deformable body defining the inner cavity and having a pouring end defining an opening;

(ii) providing a restriction piece through which the liquid flow passage extends, the liquid flow passage being smaller than the opening of the resilient deformable body;

(iii) placing the free floating buoyant member into the inner cavity of the resilient deformable body; and (iv) engaging the restriction piece with the resilient deformable body in a manner sealing therewith adjacent the open end thereof to communicate the liquid flow passage with the inner cavity.

11. The method as defined in claim 10 wherein the restriction piece comprises a bushing and step (a)(iv) comprises inserting the bushing into the resilient deformable body through the opening to fit the bushing concentrically within and against the resilient deformable body adjacent the pouring end.

12. The method as defined in claim 11 wherein the resilient deformable body comprises a neck that defines the pouring end thereof and into which the bushing is inserted in step (a)(iv).

13. The method as defined in claim 10 wherein the restriction piece comprises an extension arranged to connect to the resilient deformable body adjacent the open end thereof to project and narrow away from the open end of the resilient deformable body to define a neck of the container.

14. The method as defined in claim 13 wherein step (a)(i) comprises blow molding the resilient deformable body.

15. The method as defined in claim 13 wherein step (a)(ii) comprises injecting molding the restriction piece.

* * * * *